US009226584B2

(12) United States Patent
Swy

(10) Patent No.: US 9,226,584 B2
(45) Date of Patent: Jan. 5, 2016

(54) FOLDING BOOK HOLDER FOR CHAIR

(71) Applicant: Michigan Tube Swagers & Fabricators, Inc., Temperance, MI (US)

(72) Inventor: Joshua Paul Swy, Lambertville, MI (US)

(73) Assignee: Michigan Tube Swagers & Fabricators, Inc., Temperance, MI (US)

( * ) Notice: Subject to any disclaimer, the term of this patent is extended or adjusted under 35 U.S.C. 154(b) by 50 days.

(21) Appl. No.: 14/097,952

(22) Filed: Dec. 5, 2013

(65) Prior Publication Data

US 2014/0152060 A1 Jun. 5, 2014

Related U.S. Application Data

(60) Provisional application No. 61/733,666, filed on Dec. 5, 2012.

(51) Int. Cl.
*A47C 7/62* (2006.01)

(52) U.S. Cl.
CPC ..... *A47C 7/62* (2013.01)

(58) Field of Classification Search
CPC ..... A47C 7/62
USPC ..... 297/188.08, 188.1, 188.12, 188.01
See application file for complete search history.

(56) References Cited

U.S. PATENT DOCUMENTS

| | | | | |
|---|---|---|---|---|
| 628,605 | A * | 7/1899 | Ottenheimer | 297/188.02 |
| 757,305 | A * | 4/1904 | Henderson | 297/188.02 |
| 960,360 | A * | 6/1910 | Lynch | 297/188.02 |
| 5,794,676 | A * | 8/1998 | Shattuck | 150/131 |
| 6,161,896 | A * | 12/2000 | Johnson et al. | 297/188.1 |
| 8,544,944 | B1 * | 10/2013 | Gelley | 297/188.08 |
| 2014/0001798 | A1 * | 1/2014 | Kalergis et al. | 297/188.08 |

* cited by examiner

*Primary Examiner* — Rodney B. White
*Assistant Examiner* — Jody Giacoman
(74) *Attorney, Agent, or Firm* — Dinsmore & Shohl LLP; Douglas L. Wathen

(57) ABSTRACT

A chair with a folding book holder includes a generally horizontal seat portion with an upper surface for supporting an occupant and an opposed lower surface. The folding book holder has a bottom portion and two support portions. Each support portion has a lower edge flexibly interconnected with the bottom portion and an upper edge flexibly interconnected with the chair. The bottom portion and support portions are foldable between a use position and a storage position, wherein in the use position the support portions extend generally downwardly from the seat portion and the bottom portion is spaced from the seat portion, and in the storage position the support portions and bottom portion are folded up against the seat portion.

9 Claims, 7 Drawing Sheets

FIG. 9
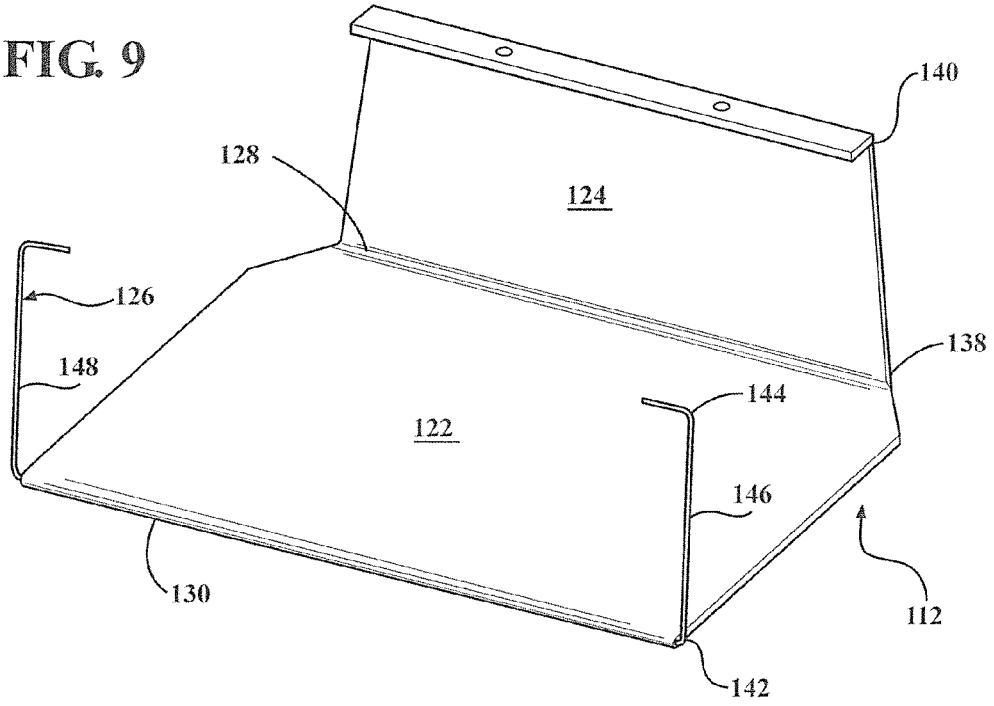
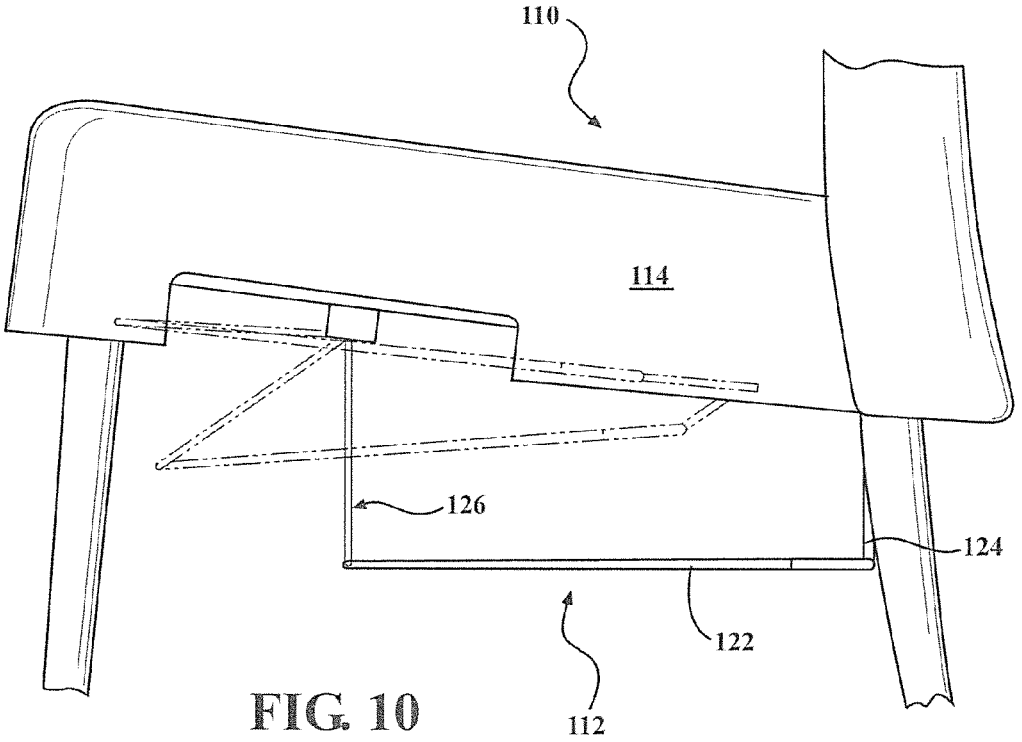
FIG. 10

FOLDING BOOK HOLDER FOR CHAIR

CROSS-REFERENCE TO RELATED APPLICATION

This application claims priority from U.S. provisional patent application Ser. No. 61/733,666, filed Dec. 5, 2012, the content of which is incorporated herein in its entirety.

FIELD OF THE INVENTION

The present invention relates generally to chairs and, more specifically, to a folding book holder for chairs.

BACKGROUND OF THE INVENTION

It is often desirable to provide a storage area for use by an occupant of a chair. This is especially true where chairs are being used in a conference center or auditorium and the chair occupants have notebooks or other items. Chair occupants are often forced to place such materials on the floor or on adjacent chairs. As such, it is desirable to provide a book holder that provides a location to place such materials when not being used. It is also desirable that such a book holder be foldable to a storage position when not needed. Typically, chairs that are used in conference centers and auditoriums are stacked when not in use. A plurality of chairs are placed in a generally vertical stack with each chair resting on top of a like chair in the stack. For such stacking chairs, it is desirable that a book holder fold into a compact storage position so as not to interfere with the stacking or substantially increase the stack height of the chairs.

SUMMARY OF THE INVENTION

The present invention provides a chair with a folding book holder. In a particular embodiment, a chair has a generally horizontal seat portion with an upper surface for supporting an occupant and an opposed lower surface, and four legs supporting the seat portion. A folding book holder has a bottom portion and two support portions. The bottom portion has a first edge and an opposed second edge. The first support portion has a lower edge flexibly interconnected with the first edge of the bottom portion and an upper edge flexibly interconnected with the lower surface of the seat portion of the chair. The second support portion has a lower edge flexible interconnected with the second edge of the bottom portion and an upper edge flexibly interconnected with the lower surface of the seat portion of the chair. The bottom portion and support portions are foldable between a use position and a storage position, wherein in the use position the support portions extend generally downwardly from the seat portion and the bottom portion is spaced from the seat portion, and in the storage position the support portions and bottom portion are folded up against the seat portion.

In some versions, the bottom portion is generally perpendicular to the support portions in the use position and the bottom portion and the support portions are generally coplanar in the storage position.

In some versions, the bottom portions and support portions each include a stiffener and a fabric cover covers the stiffeners and forms the flexible interconnection between the support portions and the bottom portion.

In some versions, a latch is provided for retaining the book holder in the storage position. The latch may include a magnet attached to the lower surface of the seat portion and a metal element interconnected to the folding book holder such that the metal element contacts the magnet in the storage position.

In some versions, the first and second edges of the bottom portion are side edges and the first and second support portions are side portions. Therefore, the bottom portion moves sideways and upwardly when the book holder is folded from the use position to the storage position.

BRIEF DESCRIPTION OF THE DRAWINGS

FIG. 9 is a perspective view of the folding book holder of FIGS. 7 and 8 without the chair; and FIG. 10 is a side view of a portion of the chair and folding book holder of FIGS. 7 and 8 with the book holder shown in solid lines in a use position and in a partially folded and in a storage position in broken lines.

DETAILED DESCRIPTION OF THE INVENTION

Figure 1:
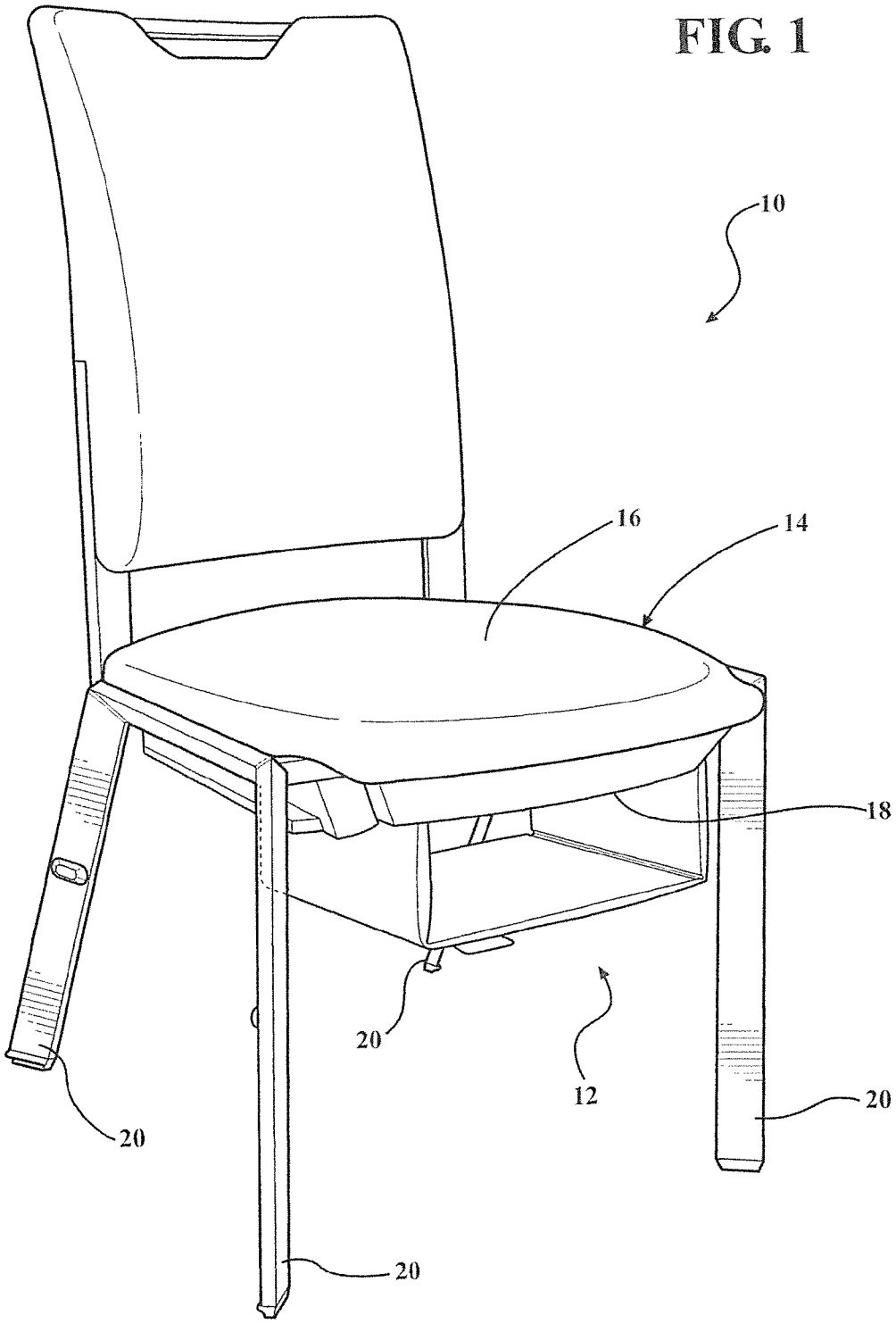
FIG. 1 is a perspective view of a chair with a folding book holder in accordance with an embodiment of the present invention.

FIG. 1 shows a chair 10 with a folding book holder 12 attached thereto. The chair has a seat portion 14 with an upholstered upper surface 16 for supporting an occupant and an opposed lower surface 18. The seat portion 14 is supported in a generally horizontal position by four chair legs 20. The illustrated chair 10 is a particular type and style of stacking chair wherein a plurality of like chairs may be stacked in a generally vertical stack. A chair is positioned atop a like chair with the legs 20 of the upper chair engaging the legs of the lower chair so as to form a stable stack. While the book holder 12 may be used with this particular chair 10, the book holder may also be used with a wide variety of other types of chairs, including chairs not configured to stack or nest.

Figure 2:
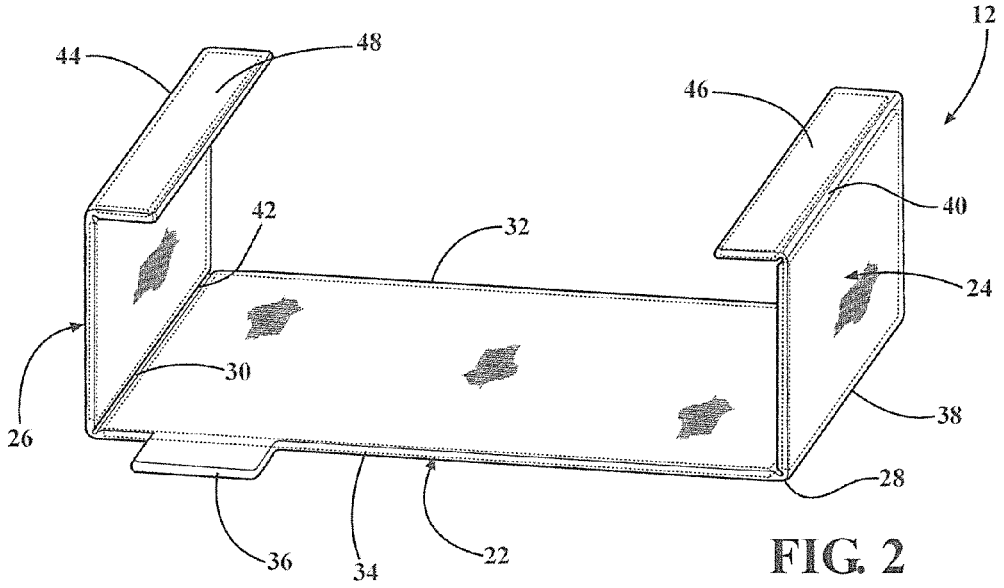
FIG. 2 is a perspective view of a book holder in accordance with an embodiment of the present invention.

Referring now to FIG. 2, a view of an embodiment of the book holder 12 is shown. The book holder 12 has a bottom portion 22, a first side portion 24, and a second side portion 26. The side portions 24 and 26 may also be referred to as support portions. In the illustrated embodiment, the bottom portion 22 is a generally planar body that extends between a first edge 28 and an opposed second edge 30. The planar body is generally rectangular with a rear edge 32 and a generally parallel front edge 34 each extending between the first side edge 28 and second side edge 30. A tab 36 may extend from the front edge to be used for moving the book holder between the use and storage positions. The first side portion 24 may be said to have a lower edge 38 that is flexibly interconnected with the first side edge 28 of the bottom portion 22 and an upper edge 40 that is flexibly interconnected with the seat portion of the chair. Likewise, the second side portion 26 has a lower edge 42 flexibly interconnected with the second side edge 30 of the bottom portion 22 and an upper edge 44 flexibly interconnected with the seat portion of the chair. In the illustrated embodiment, connection elements 46 and 48 are flexibly interconnected with the upper edges 40 and 44, respectively, of the side portions 24 and 26. The connection portions 46 and 48 are connected to the lower surface 18 of the seat portion 14 of the chair 10. In the illustrated embodiment, the side portions 24 and 26 are each also generally rectangular planar bodies. Alternatively, they may have other shapes or be non-planar. In the illustrated embodiment, the bottom portion 22 and side portions 24 and 26 each include a stiffening element such that they retain their illustrated shape. In alternative embodiments, the side portions 24 and 26 may lack the stiffening portions and instead be entirely flexible.

Figure 3:
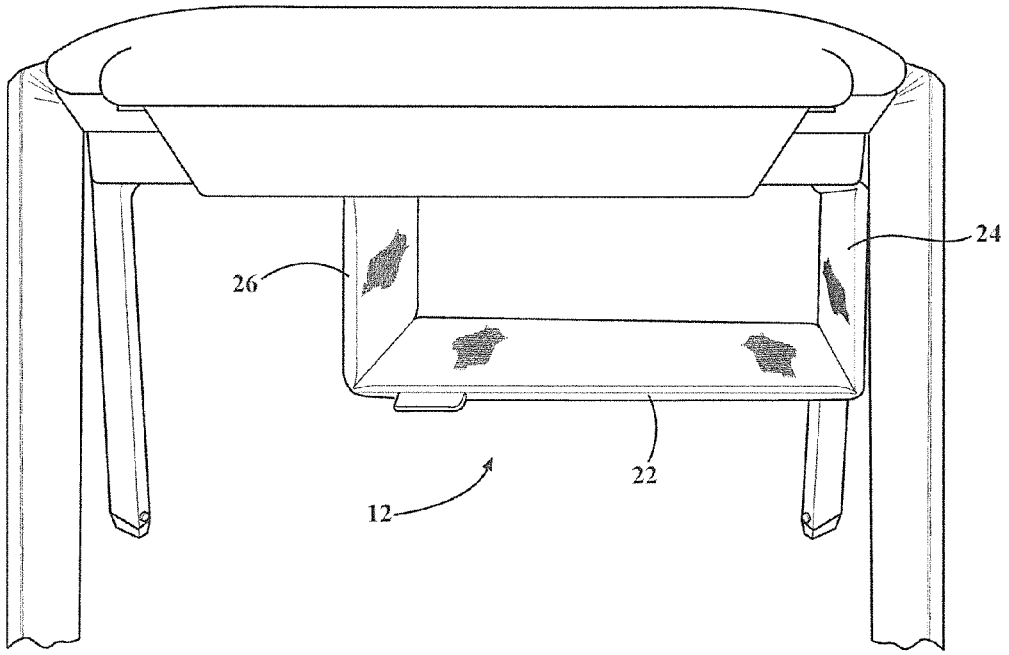
FIG. 3 is a front view of a portion of a chair with a folding book holder in a use position.
Figure 4:
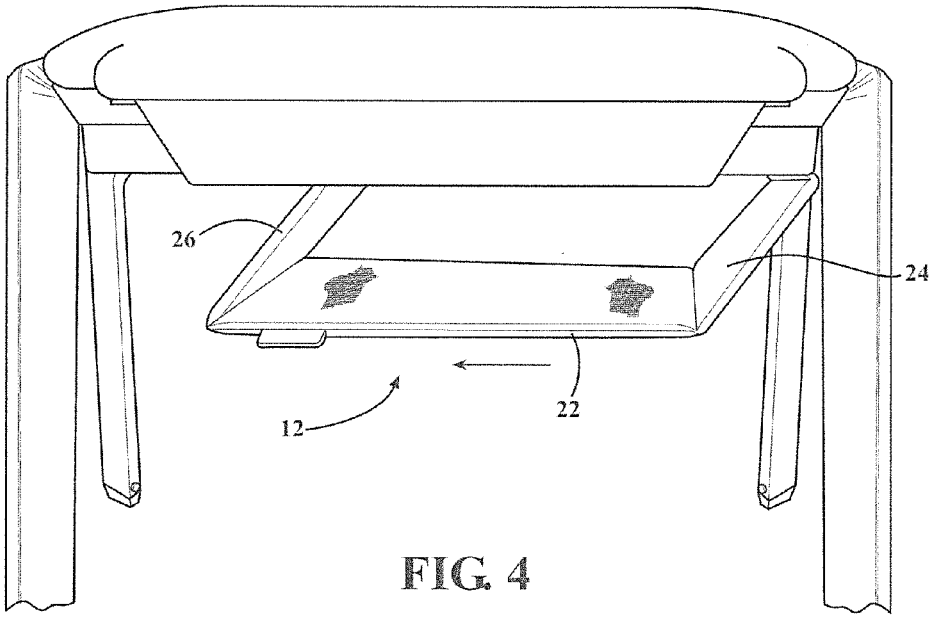
FIG. 4 is a view similar to FIG. 3 with the book holder being partially folded.
Figure 5:
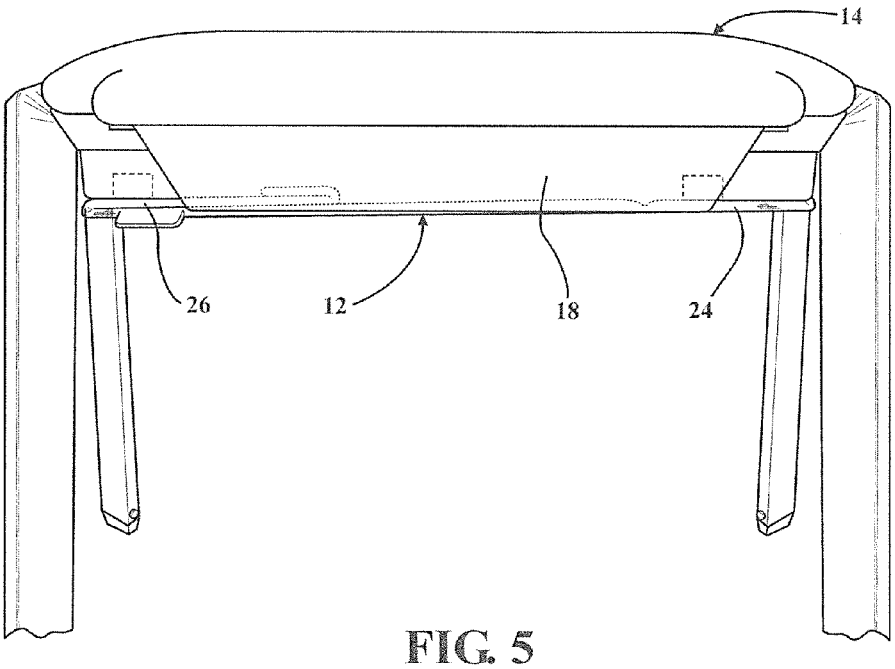
FIG. 5 is a view similar to FIGS. 3 and 4 with the book holder folded into a storage position.

Referring now to FIG. 3, the book holder 12 is shown in the use position. As shown, the bottom portion 22 is generally perpendicular to the side portions 24 and 26. FIG. 4 illustrates the book holder 12 being folded towards a storage position. As shown, the bottom portion 22 and side portions 24 and 26 form a four bar mechanism. FIG. 5 illustrates the book holder 12 folded into a storage position wherein it is generally flush with the lower surface 18 of the chair seat portion 14. In this position, the bottom portion and side portions may generally be parallel to one another and may be considered to be coplanar.

Figure 6:
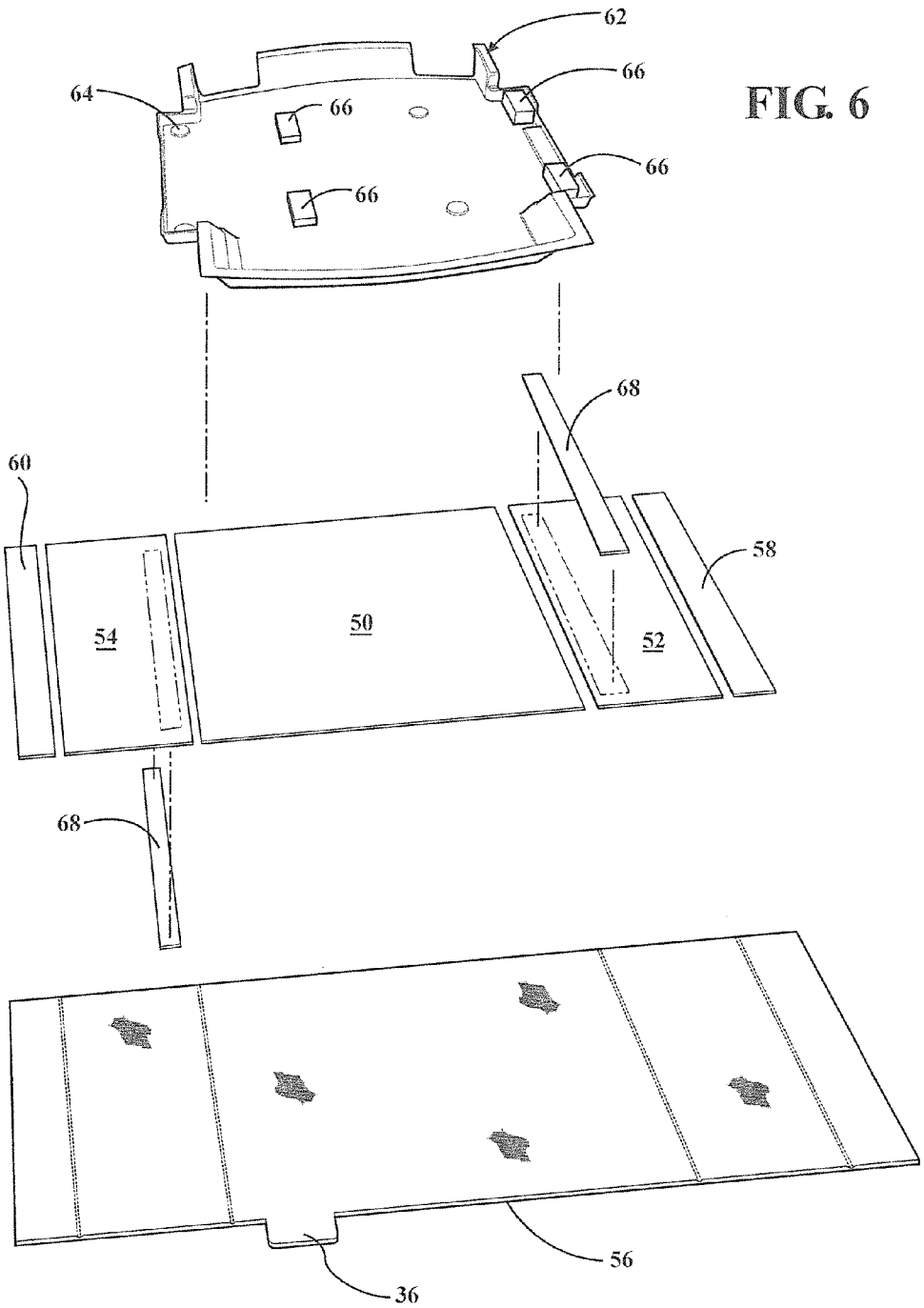
FIG. 6 is an exploded view of the folding book holder showing the component pieces.
Figure 7:
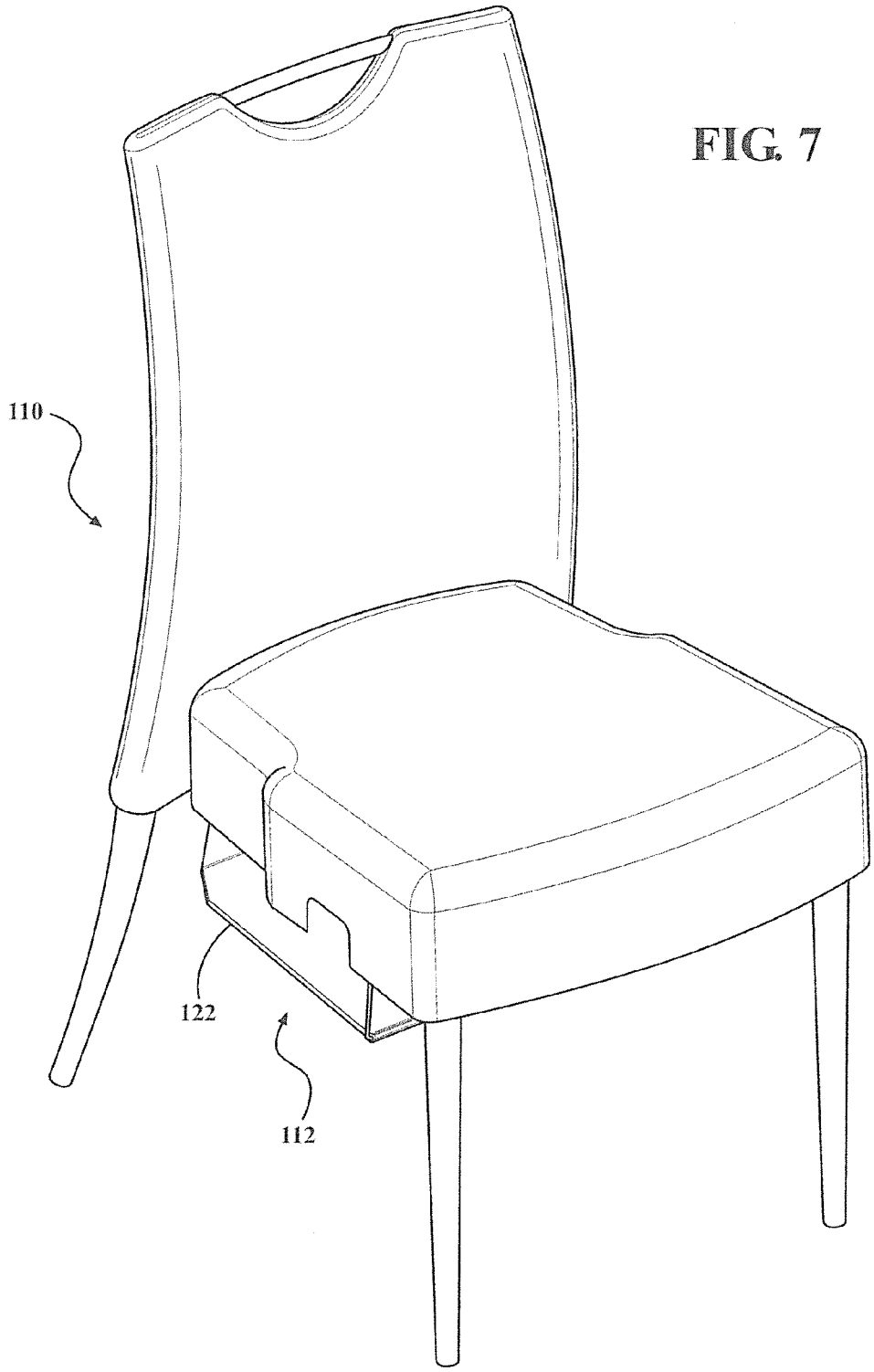
FIG. 7 is a perspective view of a chair with a folding book holder in accordance with a second embodiment of the present invention.
Figure 8:
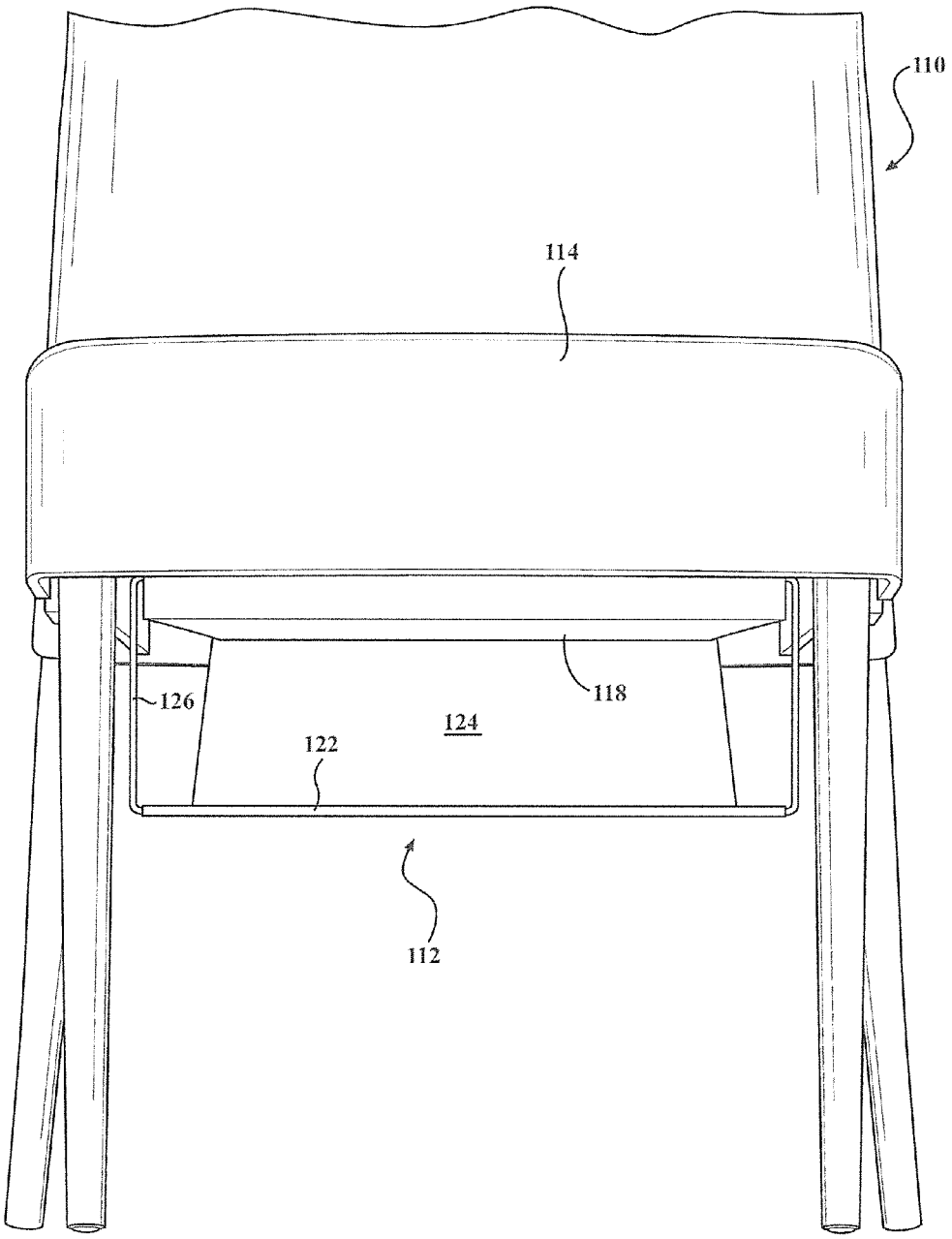
FIG. 8 is a front view of a portion of the chair and folding book holder of FIG. 7.

Referring now to FIG. 6, an embodiment of the book holder 12 in accordance with the present invention is shown in an exploded view. As shown, the bottom portion includes a generally rectangular stiffener element 50. Likewise, the first side portion includes a stiffener element 52 and the second side portion includes a stiffener element 54. The stiffener elements are covered by a fabric sock 56 that covers and interconnects the stiffener elements 50-54 and also forms the "hinges" between these portions. In alternative embodiments, the flexible interconnection between the portions may be formed in other ways, including actual hinges or living hinges. In this embodiment, the tab is formed by the sock, but it may instead cover part of the stiffener element 50, or may be excluded. As shown, the connection portions may also have stiffener elements 58 and 60, respectively, also covered by the sock.

A seat pan is shown at 62. This seat pan attaches to the bottom of the chair frame and covers the underside of the seat. In the illustrated embodiment, the seat pan is a molded plastic element. It includes attachment points 64. The connection portions may be attached thereto by fasteners.

In some embodiments, a latch is provided to retain the book holder in the storage position. This may take a variety of forms. In one embodiment, magnets 66 are interconnected with the seat pan 62 and corresponding metal portions 68 is interconnected with the book holder 12 so that in the folded storage position the metal portions 68 contact the magnets 66 and hold the book holder in the folded position. In this embodiment, the magnets 66 are on the inside of the seat pan 62 and the metal portions 68 are attached to the side portions of the book holder. Other approaches to latching, such as the use of hook and loop fastener material, may be applied to the present invention.

Referring now to FIGS. 7-10, a chair 110 is shown with a second embodiment of a folding book holder 112. Again, the chair 110 represents one style of chair for use with a book holder, but the book holder 112 may be used with other styles and types of chairs.

The book holder 112 is similar to the first embodiment in that it has a bottom portion 122 that is a generally planar body and, in the use position, is generally horizontal, and spaced from the lower surface 118 of the seat portion 114 of the chair 110. The book holder 112 further includes a first support portion 124 and a second support portion 126 that flexibly interconnect the bottom portion 122 of the book holder with the seat portion 114 and allow movement between a use position and a storage position. In this embodiment, the first support portion 124 is a rear portion and the second support portion 126 is a front portion, though other orientations are possible.

Referring to FIG. 9, the bottom portion 122 may be said to have a first edge 128 and an opposed second edge 130, with these edges being rear and front edges, respectively, in this embodiment. The first support portion 124 may be said to have a lower edge 138 that is flexibly interconnected with the first edge 128 of the bottom portion 122 and an upper edge 140 that is flexibly interconnected with the seat portion of the chair. These flexible connections may be made in a variety of ways, as discussed for the prior embodiment. In this embodiment, the first support portion is a generally planar body. As shown, it may be narrower, side to side, than the side to side width of the main part of the bottom portion.

The second support portion 126 may be said to have lower edge 142 flexibly interconnected with the second edge 130 of the bottom portion 122 and an upper edge 144 flexibly interconnected with the seat portion. In the illustrated embodiment, the second support portion 126 takes the form of a wire element with the lower edge 142 being a straight section of wire engaging the second edge 130 of the bottom portion 122. The wire element further includes side sections 146 and 148 that extend upwardly, generally perpendicularly, from the straight section to the upper edge 144. The upper edge is defined by inwardly extending ends of the wire element, and these engage receivers on the seat portion. This provides a support portion 126 that is open in the middle such that a book may be passed therethrough to rest on the bottom portion 122. The support portions may take other forms.

FIG. 10 provides a side view of the book holder 112 in the use position in solid lines. As shown, the support portions 124 and 126 are generally vertical and are generally perpendicular to the bottom portion in this position. The book holder 112 is also shown, in broken lines, in partially folded and in the storage position. In the storage position, the book holder may be said to be adjacent the seat portion and the bottom portion and support portions may be said to be generally coplanar. The book holder 112 may further include a tab, not shown, and/or a latch of any type, also not shown, for retaining the book holder in the storage position.

As will be clear to those of skill in the art, the herein described embodiments of the present invention may be altered in various ways without departing from the scope or teaching of the present invention. It is the following claims, including all equivalents, which define the scope of the present invention.

The invention claimed is:

1. A chair with a folding book holder, comprising:

a chair having a generally horizontal seat portion with an upper surface for supporting an occupant and an opposed lower surface, the chair having four legs supporting the seat portion;

a folding book holder having a bottom portion and two support portions;

the bottom portion having a first edge and an opposed second edge;

the first support portion having a lower edge flexibly interconnected with the first edge of the bottom portion and an upper edge flexibly interconnected with the lower surface of the seat portion of the chair;

the second support portion having a lower edge flexible interconnected with the second edge of the bottom portion and an upper edge flexibly interconnected with the lower surface of the seat portion of the chair; and the bottom portion and support portions forming a four bar mechanism and being foldable between a use position and a storage position;

wherein in the use position the support portions extend generally downwardly from the seat portion and the bottom portion is spaced from the seat portion, and in the storage position the bottom portion are folded up against the seat portion with one of the support portions being disposed between the bottom portion and the seat portion and the other of the support portions being disposed adjacent to and generally coplanar with the bottom portion.

2. A chair with a folding book holder in accordance with claim 1, wherein:

the bottom portion is generally perpendicular to the support portions in the use position.

3. A chair with a folding book holder in accordance with claim 1, wherein:

the bottom portion and support portions each include a stiffener;

a fabric cover covering the stiffeners and forming the flexible interconnection between the support portions and the bottom portion.

4. A chair with a folding book holder in accordance with claim 1, further comprising:

a latch for retaining the book holder in the storage position.

5. A chair with a folding book holder in accordance with claim 4, wherein:

the latch includes a magnet attached to the lower surface of the seat portion and a metal element interconnected to the folding book holder such that the metal element contacts the magnet in the storage position.

6. A chair with a folding book holder in accordance with claim 1, wherein:

the first and second edges of the bottom portion are side edges and the first and second support portions are side portions;

the bottom portion moving sideways and upwardly when the book holder is folded from the use position to the storage position.

7. A chair with a folding book holder in accordance with claim 1, wherein the first support portion is a rear portion and the second support portion is a front portion, the bottom portion moving forwardly and upwardly when the book holder is folded from the use position to the storage position.

8. A chair with a folding book holder in accordance with claim 1, wherein the second support portion is open in the middle such that a book may be passed through the second support portion to rest on the bottom portion.

9. A chair with a folding book holder in accordance with claim 8, wherein the second support portion is a wire element having a straight section defining the lower edge and side sections extending from the straight section.

* * * * *